US006055834A

United States Patent [19]

Della Vedova et al.

[11] Patent Number: 6,055,834

[45] Date of Patent: May 2, 2000

[54] METHOD TO CONTROL THE DRAWING OF THE ROLLED STOCK

[75] Inventors: Ferruccio Della Vedova, Zugliano; Lorenzo Ciani, Udine; Paolo Chiaruttini, Colloredo Di Prato, all of Italy

[73] Assignee: Centro Automation SpA, Buttrio, Italy

[21] Appl. No.: 09/204,070

[22] Filed: Dec. 3, 1998

[30] Foreign Application Priority Data

Apr. 12, 1997 [IT] Italy ..... UD97A0226

[51] Int. Cl.[7] ..... B21B 37/68

[52] U.S. Cl. ..... 72/8.9; 72/7.4; 72/7.6; 72/11.6; 72/12.8; 72/365.2

[58] Field of Search ..... 72/7.4, 7.6, 8.9, 72/11.6, 12.7, 12.8, 226, 234, 274, 278, 365.2

[56] References Cited

U.S. PATENT DOCUMENTS

| | | | |
|---|---|---|---|
| 4,537,051 | 8/1985 | Niino et al. | 72/11.6 |
| 4,558,576 | 12/1985 | Reardon et al. | 72/8.9 |
| 4,607,511 | 8/1986 | Shore . | |

FOREIGN PATENT DOCUMENTS

| | | | |
|---|---|---|---|
| 219316 | 4/1987 | European Pat. Off. . | |
| 756906 | 2/1997 | European Pat. Off. . | |
| 1452062 | 10/1969 | Germany . | |
| 61-159217 | 7/1986 | Japan | 72/12.7 |

OTHER PUBLICATIONS

Patent Abstracts of Japan, vol. 16, No. 314 (M–1278), Jul. 9, 1992 & JP 04 089124 A (Daido Steel Co Ltd), Mar. 23, 1992—abstract.

Patent Abstracts of Japan, vol. 009, No. 235 (M–415), Sep. 21, 1985 & JP 60 092009 A (Toshiba KK), May 23, 1985—abstract.

*Primary Examiner*—Ed Tolan
*Attorney, Agent, or Firm*—Antonelli, Terry, Stout & Kraus, LLP

[57] ABSTRACT

A method to control the drawing of rolled stock in a segment of the rolling line includes measuring the section of the rolled stock passing through is made by a first detector located at the outlet of the semi-finishing block and by a second detector located at the inlet to the finishing block. The method also carries out at least a measurement of the section of the rolled stock with a third detector located at the outlet of the finishing block, the drawing action being controlled and regulated by a control unit by comparing the measurements of the section at the outlet of the semi-finishing block, at the inlet to the finishing block and at the outlet thereof with the corresponding values memorized in tables in the control unit. Any divergences included in an admissible correction range with respect to the expected values are corrected by the control unit acting in feedback on the drawing means of the rolled stock in the segment of the line so as to return the dimensional value of the section of the rolled stock to around the expected value.

6 Claims, 1 Drawing Sheet

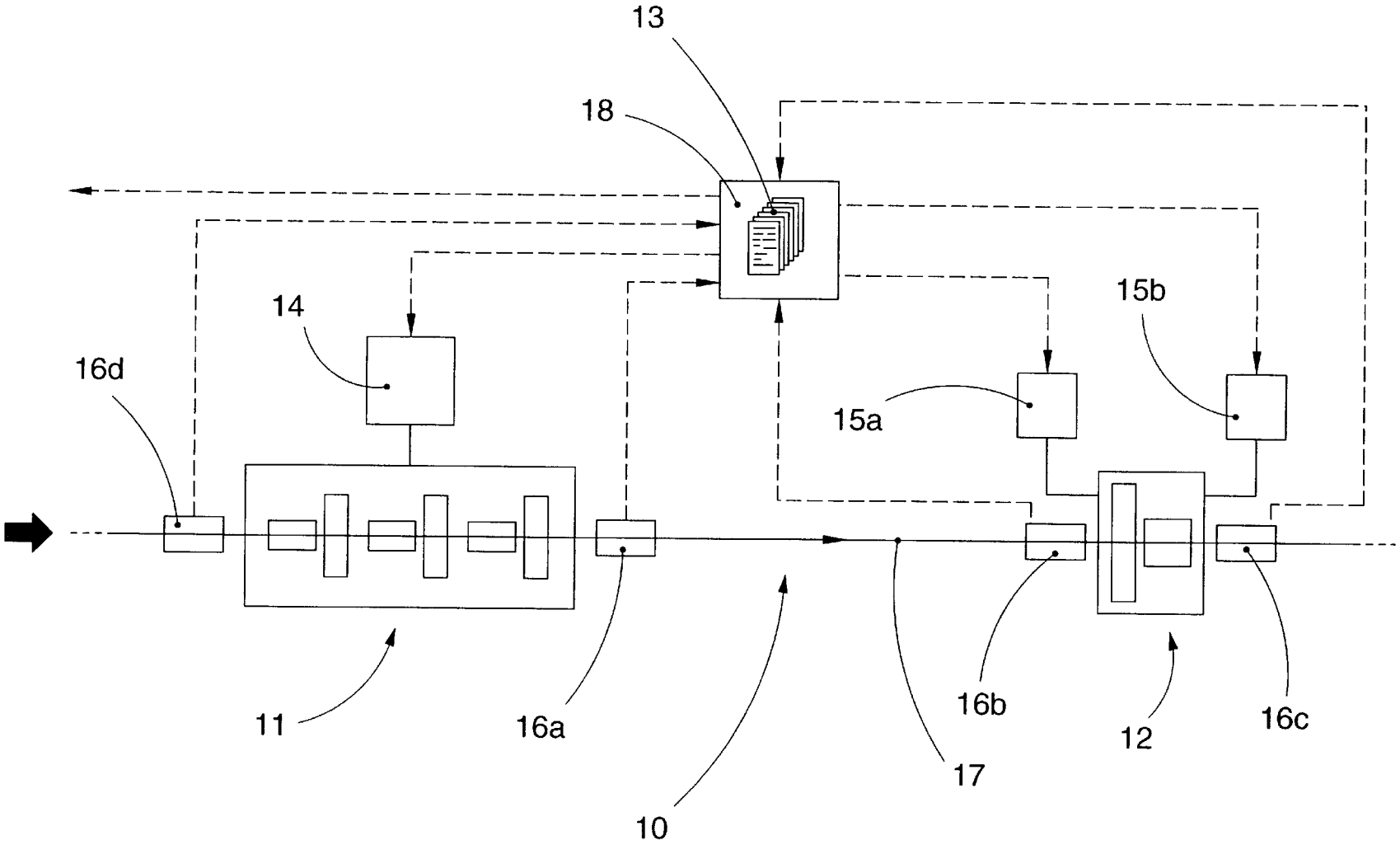
16c
15b
12
16b
17
15a
13
18
10
16a
14
11
16d

METHOD TO CONTROL THE DRAWING OF THE ROLLED STOCK

FIELD OF THE INVENTION

This invention concerns a method to control the drawing action of rolled stock.

The invention is applied in a rolling line to control and regulate the drawing action imparted to the rolled stock in order to guarantee that the dimensional tolerances of the final product are respected and that characteristics of high quality are obtained, in terms of a rigorous respect of the dimensional parameters established.

The invention also makes it possible to avoid the formation of critical points or deformations in section lengthwise to the rolled stock caused by a drawing action which is excessive, or not uniform or constant.

BACKGROUND OF THE INVENTION

It is well-known that one of the most considerable problems found in hot-rolling lines, particularly in lines for long products in bars, is the need to keep under constant control the drawing action on the rolled stock between an upstream stand and a downstream stand, or between a stand and a drawing assembly or again in the same stand where there are two or more rolling modules or blocks combined.

This requirement is increased when, in a segment between stands, there are heat treatment or conditioning systems which can modify the structural characteristics of the material, upstream and downstream of the systems, in terms of resistance to the drawing action and which therefore make it difficult to control and regulate the drawing action in the inter-stand segment.

If the drawing action is irregular and/or inconstant in time, it will cause an unacceptable deterioration in quality and dimensional irregularities which cause reduced yields, stoppages in the line, a need for frequent adjustments and other problems which negatively affect the operativity and productivity of the line.

Moreover, if the drawing action is not controlled precisely and constantly, it is not possible to make those adjustments to the line which allow the product to be maintained within strict dimensional tolerances in a rigorous and automated manner which can be repeated whatever the conditions upstream may be, without having recourse to complex and intricate adjustments to the gap between the rolls; these adjustments cause stoppages of the line, for the most part they are entrusted to the workers' experience and skill and cause operational pauses which negatively affect the productivity of the line.

In the state of the art various solutions have been proposed to rigorously measure the drawing action and to control in feedback the drawing assemblies in order to maintain controlled and constant drawing conditions.

For example, some solutions have proposed diameter measuring devices located immediately at the outlet of the rolling stand, or at the inlet and outlet of the stand, and governing in feedback the motors of the rolls in the event that there is any divergence with respect to the expected nominal dimension.

Measuring devices have also been proposed which detect the tension of the rolled stock in the segment between stands so as to determine dimensional pulses in the section and thus establish the relative drawing conditions.

These and other solutions of the state of the art have not, however, given a complete and satisfactory solution to the technological and operational need to guarantee a control of the drawing action which is both reliable, simple, economical, practical and extremely accurate.

The present Applicant, in the European Patent application EP-A-0756906, proposed an innovative solution to control the drawing action of the rolled stock, based on at least two dimensional detectors in the segment between the stands: a first detector immediately at the outlet of the upstream stand and a second detector immediately at the inlet of the downstream stand. In the event that there is a heat treatment performed in the inter-stand segment there is also a dimensional detector upstream of the treatment.

This solution indeed gives precise information on the regular condition of the drawing action of the rolled stock, inasmuch as it identifies unacceptable dimensional deformities and reductions in section caused by irregular and inconstant drawing in the inter-stand segment.

Although this embodiment is in itself positive, it does not determine any irregularities in the rolling or drawing which occur inside the stand itself, or between rolling blocks combined in the same block; nor does it identify with precision the reasons which cause the irregularities, in order to intervene with a feedback command so as to restore the correct rolling and drawing conditions.

DE-A-1.452.062 describes a method to adjust the size of steel shapes subjected to rolling.

This document explains how and in what position to use rolling finishing stands which form arcs in the material, which have the function of reducing the surface defects, in terms of size, of the product which has been rolled.

It also explains how the adjustment in size of the rolled stock is carried out by means of two methods, wherein the thickness of the rolled stock is corrected by choosing the position of the stands wherein arcs are formed in the material in the rolling train, whereas the width is corrected by adjusting the number of revolutions of the first command device in the finishing train.

This document therefore includes two systems of measuring the size in order to verify that tolerances are respected at the outlet of the finishing train, a first system which measures the thickness of the rolled stock and a second system which measures the width of the rolled stock.

This document describes a complex system, which requires two distinct measuring systems, each for one size of the rolled stock, connected to two respective adjustment systems which work independently of each other.

This system involves complex operations and very long adjustment times, inasmuch as making a correction to the size, for example to the thickness, can increase the defect of size in the width, and vice versa; this leads to a continual chasing after the correct values by means of successive adjustments.

Moreover, the apparatus is costly, complex to manage and complex in functioning.

Furthermore, this document does not take into account the fact that the round piece emerging at high speed from the finishing block is subject to torsion on its own axis.

Because the section of the round piece is not perfectly circular, this torsion has the result that the measurements made independently of the thickness and the width are completely distorted and cause corrections to be made which are not even necessary, or on the contrary do not recognise values which are outside the tolerance limits because the measurement has not been made in the correct position.

The Applicant has devised and embodied this invention to solve these problems with a global method which will ensure the constant dimensional control of the rolled stock with a simple, economical, reliable and functional solution.

SUMMARY OF THE INVENTION

The invention is applied in a rolling line, particularly but not exclusively in the semi-finishing/finishing segment of the line for long products in bars.

"Semi-finishing/finishing segment" means the segment of the line consisting of a fast-rolling block with multiple reduction passes, for example, from 6 to 12, followed by a finishing or post-finishing block with one or two reduction passes.

With this invention it is possible to have a reliable, economical and functional dimensional control of the rolled stock, based on the regulation of the drawing action.

To be more exact, the invention uses only one system of measuring the size which directly measures the section of the rolled stock emerging from the finishing train, and only one system of correcting the size, which is directly connected to the said measuring system.

The system of measuring the section can be of any type, even though it is preferable to use a measuring system of a magnetic type.

The invention can be used both to avoid unacceptable deformations or reductions of the material, and also, above all, to carry out precise adjustments and corrections to the dimensions of the rolled stock by acting on the drawing parameters, thus managing to compensate, within certain limits, the dimensional deviation caused by wear on the rolling rolls or other factors of disturbance.

In other words, according to measurements of the size of the section carried out at different points in the interstand segment, or even upstream and downstream of the stands, the invention verifies that the dimensional tolerances imposed by the reduction tables are maintained and, if these tolerances are not respected, the invention acts in feedback on the drawing parameters so as to restore the correct dimensional values of the rolled stock.

This correction based on the drawing parameters is carried out within a range of admissible drawing values which is a function of the position where the measurement is made, the reciprocal position and configuration of the drawing assemblies, the type of material being rolled, its temperature and other factors.

If the measurements of the section of the rolled stock show divergences in size above an admissible range and which therefore cannot be compensated by varying the drawing action, the invention intervenes directly on the reduction assemblies upstream, or signals an error condition to indicate that intervention is necessary, for example modifying the gap between the rolls or replacing them, or other actions upstream.

The invention is based on the fact, which has been verified in the majority of practical cases, that the ratio of the reduction in section of a bar between the inlet to a fast-rolling block and the outlet thereof is substantially constant, given the same rolled material and same temperature, as the section at inlet varies, and can therefore be considered substantially independent of the inlet value, if we do not consider the deviation caused by the wear on the rolls.

If we take as known the nominal section at the inlet to the fast-rolling block, the section at outlet therefore assumes substantially a known value which is a function of the value of the section at inlet.

If we put a dimensional sensor to measure the section of the rolled stock at the outlet of the fast-rolling block, it is thus possible to verify immediately if there are any divergences from the expected value and, in that case, to intervene in feedback on the drawing systems and/or reduction systems upstream so as to restore the correct drawing conditions of the rolled stock.

According to a variant, the section at the inlet of the fast-rolling block is monitored by an appropriate dimensional sensor, which measures the section of the rolled stock as it enters the block, and compared with the section at the outlet so as to verify that the expected value of reduction is correct; in this way it is possible to continually control the increasing wear of the rolls of the fast-rolling block.

According to the invention, and according to the teachings of EP-A-0756906, in the segment between the stands between the fast-rolling block and the finishing block with one or two passes, there are at least two detectors to measure the section, one at the outlet of the fast-rolling block and the other at the inlet to the finishing block, so that the drawing action between the stands is controlled by comparing the measurements of section taken by these two detectors.

When there is a heat treatment system in the inter-stand segment, there may be three or more detectors which collaborate in the comparison made on the measurement of section of the rolled stock.

According to the invention, downstream of the finishing block with one or two passes there is another section detector.

The downstream section detector cooperates with the upstream section detector in order to compare the measurement of the rolled stock made at the inlet to the finishing block and the measurement at the outlet.

In the case of the two pass finishing block, where every pair of rolls is driven by its own motor, the section detectors govern the motors in feedback so as to correct the drawing parameters of the rolled stock, ensuring that the drawing action is maintained constantly regular between them.

With this invention, the drawing action of the rolled stock is constantly controlled, both in the inter-stand segments and also inside the finishing block itself; this ensures that the drawing action is regular and constant in time, and that the required dimensional and quality tolerances are respected.

Moreover, with this type of control it is possible to intervene on the drawing parameters to carry out fine dimensional adjustments to the section of the rolled stock within a range of admissible drawing values according to the material and the temperature.

According to the invention, the section detectors on the line are connected with a control unit which, according to pre-defined table values, verifies the divergences of the values measured from the expected values according to the reduction table and intervenes in feedback on the drawing parameters to restore the correct conditions and ensure that the dimensional tolerances of the rolled stock are respected.

BRIEF DESCRIPTION OF THE DRAWING

The attached FIGURE is given as a non-restrictive example, and shows a part of the segment of the rolling line wherein the invention is applied.

DETAILED DESCRIPTION OF THE PREFERRED EMBODIMENT

The semi-finishing/finishing segment 10 of a rolling line for long products in bars is shown in the diagram in the FIGURE. The segment 10 comprises a semi-finishing block 11, such as a BGV with multiple reduction passes, in this case six passes, followed by a finishing or post-finishing block 12 with two reduction passes. The finishing block 12 is followed by drawing, cooling and collection means such as are known to the state of the art and which are not shown here in detail.

In this case there are no heat treatment systems shown between the two blocks 11 and 12, but the invention can be applied in the same manner even when such systems are included.

The BGV 11 is fed by a motor 14, while every pair of rolls of the finishing block 12 is fed by their own motor, respectively 15*a* and 15*b*. In a variant, the semi-finishing block 11 is divided into two or more blocks, each of which is fed by a motor 14.

Immediately at the outlet of the semi-finishing block 11 there is a first dimensional detector 16*a* suitable to detect the section of the rolled stock 17 continuously passing through.

Immediately upstream of the finishing block 12 there is a second section detector 16*b,* while immediately downstream of the finishing block 12 there is a third section detector 16*c*.

In this case, there is a fourth section detector 16*d,* located upstream of the semi-finishing block 11, which verifies that the dimensional value of the rolled stock 17 entering the semi-finishing block 11 is correct.

The section detectors 16*a,* 16*b,* 16*c* and 16*d* may be of any type known to the state of the art, for example magnetic or any other type.

The dimensional detectors 16*a,* 16*b,* 16*c* and 16*d* are connected to a control unit 18, inside which the values concerning the expected dimension of the rolled stock 17 at all the points of the line wherein the measurement is carried out are memorised in the appropriate tables 13, according to the type of material being rolled, the planned table of reduction, any possible intermediate heat treatment processes, etc.

According to a variant, the control unit 18 also receives signals concerning the actual speed of the motors 14, 15*a,* 15*b,* so that they remain, whatever the condition, within a range of admissible values memorised in the tables 13.

According to a further variant, in defining the control procedure the method also takes into consideration the measurement of the period of time the rolls have been functioning, so as to verify if any possible divergences are caused by wear due to the repeated rolling passes.

According to the invention, in the procedure to control and adjust the drawing action of the rolled stock 17, there is a first control carried out according to the dimensional measurement made of the section by the first detector 16*a* downstream of the semi-finishing block 11.

This dimensional measurement takes into account the section measurement of the rolled stock 17 as it enters the semi-finishing block 11, which is known or supplied by the dimensional detector 16*d,* and the reduction ratio, substantially constant, between the upstream section and the section downstream of the block 11.

According to these known values, the first detector 16*a*, in the event of dimensional divergences between the expected measurement and the detected measurement as determined by the control unit 18, identifies possible irregularities in the size of the rolled stock 17 as it leaves the semi-finishing block 11 and determines the intervention, by the control unit 18, on the drawing assemblies upstream of the block 11 and/or on the motor 14 which drives the block 11. If there are two or more motors 14, the control unit 18 modifies the ratio of the speeds of the motors 14.

The inter-stand drawing action, that is, the drawing action between the semi-finishing block 11 and the finishing block 12, is controlled, according to the invention, by means of comparing the measurements made by the first detector 16*a* and the second detector 16*b,* according to the teachings of EP'906.

These measurements of the section make it possible to verify, according to the tables 13 memorised in the control unit 18 and/or according to parameters detected in the line, whether the drawing action in the inter-stand segment is within a range of admissible values and to determine the entity thereof.

If there are divergences which take the size of the section of the rolled stock 17 at the entrance to the finishing block 12 to a value which does not correspond to the expected value, the control unit 18 intervenes in feedback on the motors 14, 15*a,* 15*b* of the stands and/or on any drawing assemblies present, such as pinch-rolls or similar, so as to restore the correct drawing conditions.

This is also in order to make fine corrections to the dimensional value of the rolled stock 17 if this divergence is within a range of values which can be corrected simply by acting on the drawing action.

Finally, the invention provides a dimensional comparison of the measurement supplied by the third detector 16*c* downstream of the finishing block 12 and the measurement of the section supplied by the second detector 16*b* upstream of the finishing block 12.

To be more exact, since the nominal reduction ratio between the upstream section and the section downstream of the finishing block 12 is known, the dimensional comparison allows us to identify any possible irregularities in the rolling and/or any dimensional divergences with respect to the expected value, which might be due to an incorrect and inconstant drawing action by the rolls driven by the motors 15*a* and 15*b* or to wear on the rolls themselves.

According to this finding, the control unit 18 verifies that these measurements are coherent and/or that the dimensional tolerances are respected, and intervenes in feedback on the speeds of the motors 15*a* and 15*b* so as to restore correct and regular drawing conditions to the rolled stock 17. The control unit 18 can also modify the drawing conditions in the event that it is desired to correct dimensional divergences, in a defined and admissible range, with respect to the expected value.

We claim:

1. Method to control drawing action of rolled stock in a segment of a rolling line comprising at least a semi-finishing block with multiple reduction passes with one or more motors and a finishing or post-finishing block with one or two reduction passes with its own motors, comprising measuring a section of rolled stock passing through by a first detector located at an outlet of the semi-finishing block; measuring the section of the rolled stock by a second detector located at an inlet to the finishing block; measuring the section of the rolled stock with a third detector located at an outlet of the finishing block; comparing the measurements of the section at the outlet of the semi-finishing block, at the inlet to the finishing block and at the outlet of the finishing block with corresponding expected values stored in tables in a control unit; and correcting any divergences included in an admissible correction range with respect to the expected values by the control unit acting in feedback on the drawing action by controlling at least one of the motors so as to return the value of the section of the rolled stock to around the expected value.

2. Method as in claim 1, characterised in that, if the divergence of the measurement of the section of the rolled stock detected at any position whatsoever along the segment of line is outside the admissible correction range, the control unit intervenes on reduction parameters upstream and/or emits an error signal to indicate there is a divergence which cannot be corrected.

3. Method as in claim 2, characterised in that there is a finishing block with two reduction passes, each pair of rolls of the finishing block being driven by a respective motor, in which any irregularity in drawing action as determined by a dimensional comparison of the measurement of the second made at the inlet and the measurement made at the outlet of the finishing block is corrected by means of the control unit intervening on a ratio of speed of the two motors driving the rolls of the finishing block.

4. Method as in claim 1, characterised in that the measurement of the section obtained at the outlet of the semi-finishing block by the first detector is compared with an expected dimensional value of the section of the rolled stock as expected according to the measurement of the section of the rolled stock at the inlet to the semi-finishing block measured by the fourth detector and according to a substantially constant ratio of reduction determined by the semi-finishing block, any divergence with respect to the expected dimensional value being interpreted by the control unit as an indication that the rolls of the semi-finishing block are worn.

5. Method as in claim 1, characterised in that an inter-stand drawing action is measured by comparing the measurement of the section of the rolled stock obtained by the first detector at the outlet of the semi-finishing block and that obtained by the second detector at the inlet to the finishing block.

6. Method as in claim 1, characterised in that the control unit controls the speed of the motors.

* * * * *